US009409760B1

(12) United States Patent
Lichtefeld, Sr.

(10) Patent No.: US 9,409,760 B1
(45) Date of Patent: Aug. 9, 2016

(54) FLUID DISPENSER

(71) Applicant: Paul Lichtefeld, Sr., Louisville, KY (US)

(72) Inventor: Paul Lichtefeld, Sr., Louisville, KY (US)

( * ) Notice: Subject to any disclaimer, the term of this patent is extended or adjusted under 35 U.S.C. 154(b) by 0 days.

(21) Appl. No.: 14/097,964

(22) Filed: Dec. 5, 2013

(51) Int. Cl.

| | |
|---|---|
| ***B67B 3/00*** | (2006.01) |
| ***B65D 25/48*** | (2006.01) |
| ***B67B 7/44*** | (2006.01) |
| ***B67D 3/00*** | (2006.01) |
| ***B65D 77/06*** | (2006.01) |
| ***B67B 7/00*** | (2006.01) |
| ***B65D 47/06*** | (2006.01) |
| ***B65D 47/08*** | (2006.01) |
| ***B65D 47/30*** | (2006.01) |

(52) U.S. Cl.

CPC ..... *B67D 3/0061* (2013.01); *B65D 25/48* (2013.01); *B65D 47/065* (2013.01); *B65D 47/0804* (2013.01); *B65D 47/305* (2013.01); *B65D 77/067* (2013.01); *B65D 77/068* (2013.01); *B67B 7/24* (2013.01); *B67B 7/26* (2013.01); *B67B 7/44* (2013.01)

(58) Field of Classification Search

CPC ..... B67B 7/26; B67B 7/24; B67B 7/44; B65D 25/48; B65D 47/043; B65D 47/0804; B65D 77/067; B65D 77/068; B65D 47/305; B65D 47/065; B67D 3/0061

USPC ..... 222/80–81, 83, 89–91, 556

See application file for complete search history.

(56) References Cited

U.S. PATENT DOCUMENTS

| | | | | | |
|---|---|---|---|---|---|
| 163,293 | A | | 5/1875 | Banker | |
| 186,175 | A | | 1/1877 | Snyder | |
| 1,041,699 | A | | 10/1912 | Thompson, Jr. | |
| 1,209,438 | A | * | 12/1916 | Houston | 222/91 |
| 1,826,838 | A | * | 10/1931 | Stump et al. | 222/90 |
| 1,988,000 | A | | 6/1933 | Estler | |
| 2,012,396 | A | | 7/1933 | Luce | |
| 2,414,911 | A | | 2/1944 | Temple | |
| 2,373,373 | A | | 4/1945 | Berg | |
| 3,333,737 | A | * | 8/1967 | Molineux | 222/91 |
| 3,549,049 | A | * | 12/1970 | Weber | 222/91 |
| 3,768,698 | A | * | 10/1973 | Corty et al. | 222/91 |
| 4,322,018 | A | * | 3/1982 | Rutter | 222/83 |
| 4,623,077 | A | * | 11/1986 | Swartzbaugh | 222/517 |
| 4,645,100 | A | * | 2/1987 | Wells | 222/505 |
| 4,712,714 | A | * | 12/1987 | Mucciarone | 222/91 |
| 4,723,689 | A | * | 2/1988 | Vallos et al. | 222/91 |
| 4,984,711 | A | | 1/1991 | Ellis | |
| 5,090,596 | A | * | 2/1992 | Knight | 222/91 |
| 5,094,361 | A | * | 3/1992 | Dubach | 222/81 |
| 5,392,968 | A | * | 2/1995 | Dark | B65D 47/066 222/528 |
| 5,655,684 | A | * | 8/1997 | Krall | 222/91 |
| 6,053,360 | A | | 4/2000 | Rutter | |
| 6,161,728 | A | * | 12/2000 | Dark | B65D 47/36 222/153.07 |
| 7,152,767 | B2 | * | 12/2006 | Seelhofer | B65D 5/727 222/536 |
| 7,828,140 | B2 | * | 11/2010 | Lee | B65D 47/063 206/219 |
| 8,353,428 | B2 | | 1/2013 | Pritchard | |
| 2013/0008926 | A1 | | 1/2013 | Bell | |

* cited by examiner

*Primary Examiner* — Frederick C Nicolas
(74) *Attorney, Agent, or Firm* — Middleton Reutlinger

(57) ABSTRACT

The present invention comprises a dispenser for accessing and removing residual fluid from a container that includes a base portion having a chamber therein for containing the fluid, a piercing member extending from the base portion for piercing the container to access the fluid within, and an aperture in the piercing member whereby the fluid flows through the aperture into the base portion. A fluid outlet in the base portion is provided for removing fluid therefrom.

7 Claims, 8 Drawing Sheets

FLUID DISPENSER

BACKGROUND OF THE INVENTION

1. Field of the Invention

The present invention relates generally to a fluid dispenser and more particularly to a dispenser that may be used in conjunction with an existing container to remove a substantial portion of remaining fluid therefrom.

2. Description of the Related Art

Many designs and configurations fluid dispensers have been employed in the prior art. Various types of spouts, spigots, tops and dispensers have been designed in an effort to readily access and remove fluids or other liquids of varying viscosities from a container. However, many of the prior art devices enable a user to remove only a portion of the fluid from a container, rather than all of the fluid. For example, condiment and shampoo containers often frustrate consumers who struggle to remove all of the product they have purchased from the containers. Often a portion of the contents of the container is wasted because it can't be evacuated from the container due to the design or structure thereof.

Accordingly, there is a need in the art for a simple and reliable fluid dispenser that can be used in a turnkey application with existing containers for accessing and dispensing their contents. Furthermore there is a need in the art for a fluid dispenser that is relatively inexpensive to produce, easy to use with a plurality of containers, and reusable for multiple applications.

BRIEF DESCRIPTION OF THE DRAWING FIGURES

DETAILED DESCRIPTION OF THE PREFERRED EMBODIMENT(S)

Figure 2:
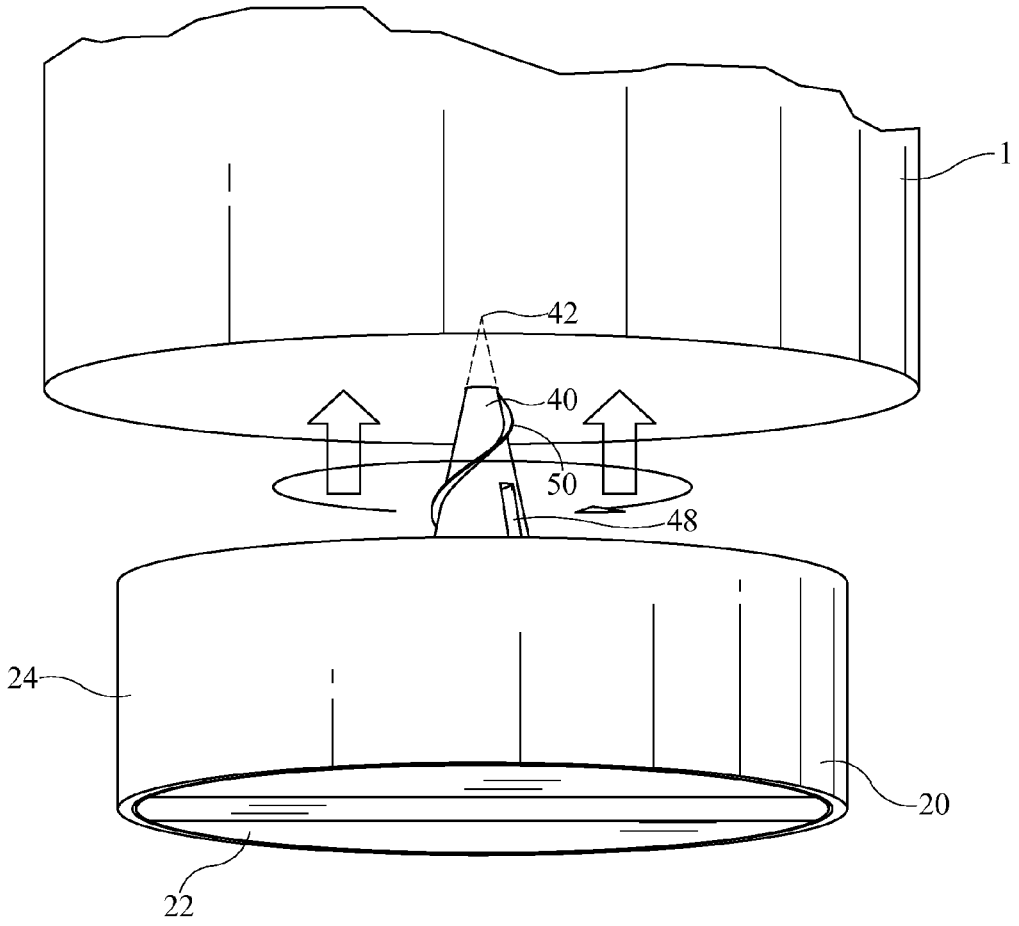
FIG. 2 is an isometric view of a fluid dispenser engaging a container in accordance with one embodiment of the present invention.
Figure 3:
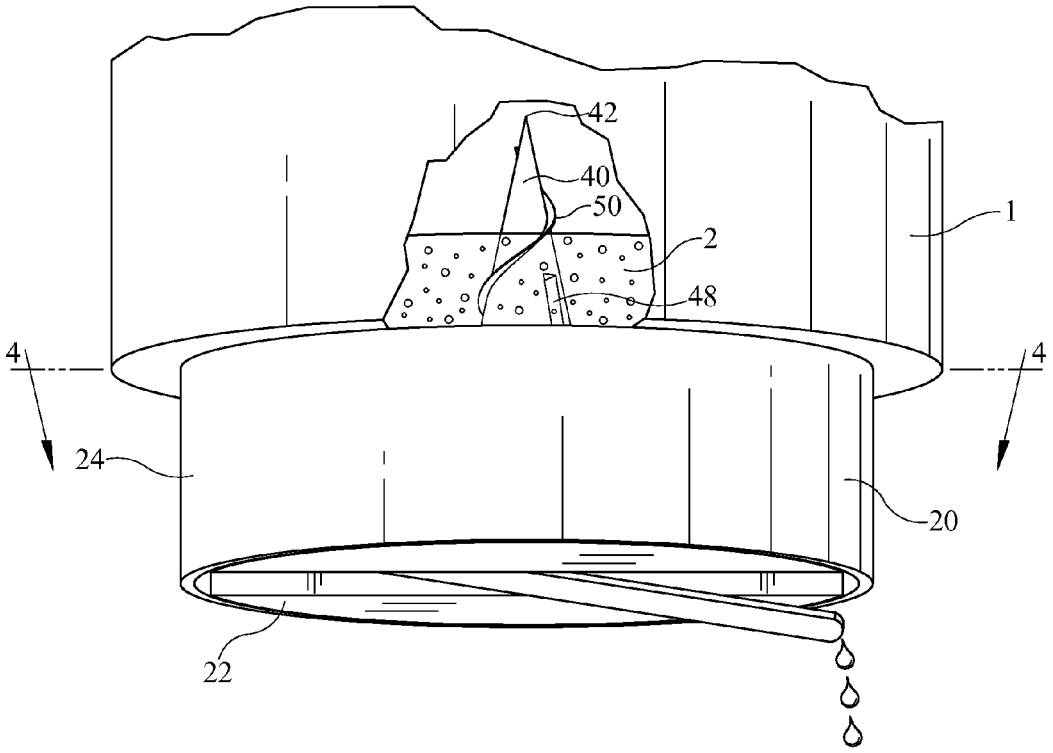
FIG. 3 is an isometric view of a fluid dispenser engaging a container in accordance with one embodiment of the present invention.
Figure 4:
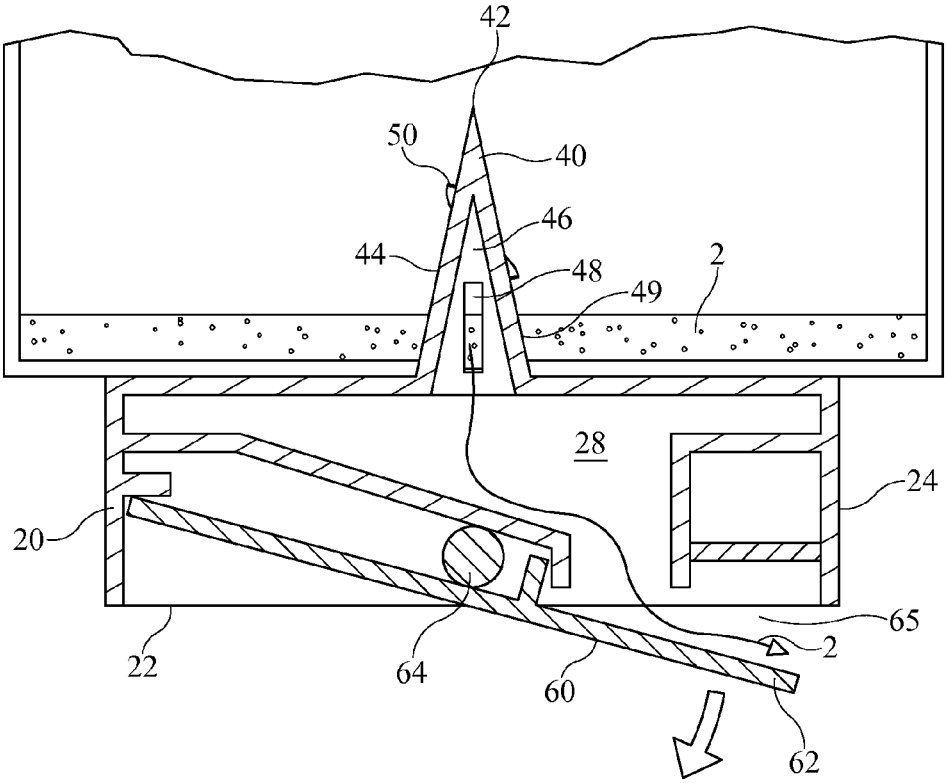
FIG. 4 is an elevation cross-sectional view of a fluid dispenser taken along the line 4-4 in accordance with one embodiment of the present invention.
Figure 5:
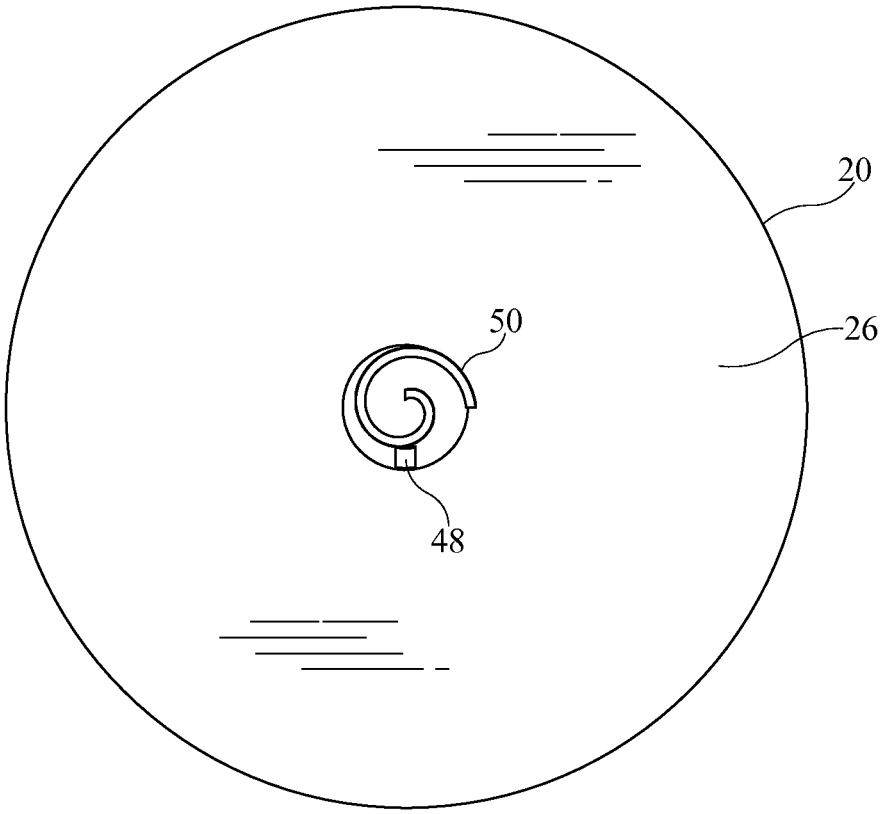
FIG. 5 is a top view of a fluid dispenser taken along the line 5-5 of FIG. 1 in accordance with one embodiment of the present invention.

Referring now to FIGS. 1-4, and in accordance with one embodiment of the present invention, a fluid dispenser 10 for removing the residue of a fluid 2 from a container 1 includes a base 20 for containing fluid 2 that is removed from container 1. Base 20 may comprise a bottom 22, and at least one side wall 24, depicted in FIG. 1 as a generally annular wall 24 that is integral with bottom 22 to contain fluid 2 as it exits container 1. Base 20 may further comprise a top portion 26 that is also connected to wall 24. As best seen in FIG. 4, bottom 22, wall 24 and top portion 26 generally define a chamber 28 into which fluid 2 flows. It should be noted that while wall 24 is shown as generally annular in the drawing Figures, dispenser 10 may employ any shape for wall 24 without departing from the scope of the invention.

Fluid dispenser 10 further comprises a piercing member 40 extending outwardly from base 20. Piercing member 40 may include a pointed distal end 42 for piercing container 1 and may further have an exterior 44 that is generally conical in shape, with a hollow interior 46. Piercing member 40 also includes an aperture 48 proximate a terminal end 49 that provides fluid communication between exterior 44 and interior 46 of piercing member 40. Piercing member 40 interior 46 communicates directly with chamber 28. In one embodiment of the invention, aperture 48 is shaped as a channel in a portion of piercing member 40 that permits fluid 2 to flow from container 1, through channel or aperture 48, into interior 46 of piercing member 40. In a further embodiment of the invention, aperture 48 may be disposed proximate top 26 of base 20 to facilitate complete evacuation of container 1.

Piercing member 40 may also comprise a helical thread or threads 50 disposed on exterior 44 thereof, that aids engagement of dispenser 10 with container 1, as discussed further herein below. Additionally, in one embodiment of the instant invention 10, piercing member 40 may extend from top portion 26 of base 20, as best seen in FIG. 4.

Figure 1:
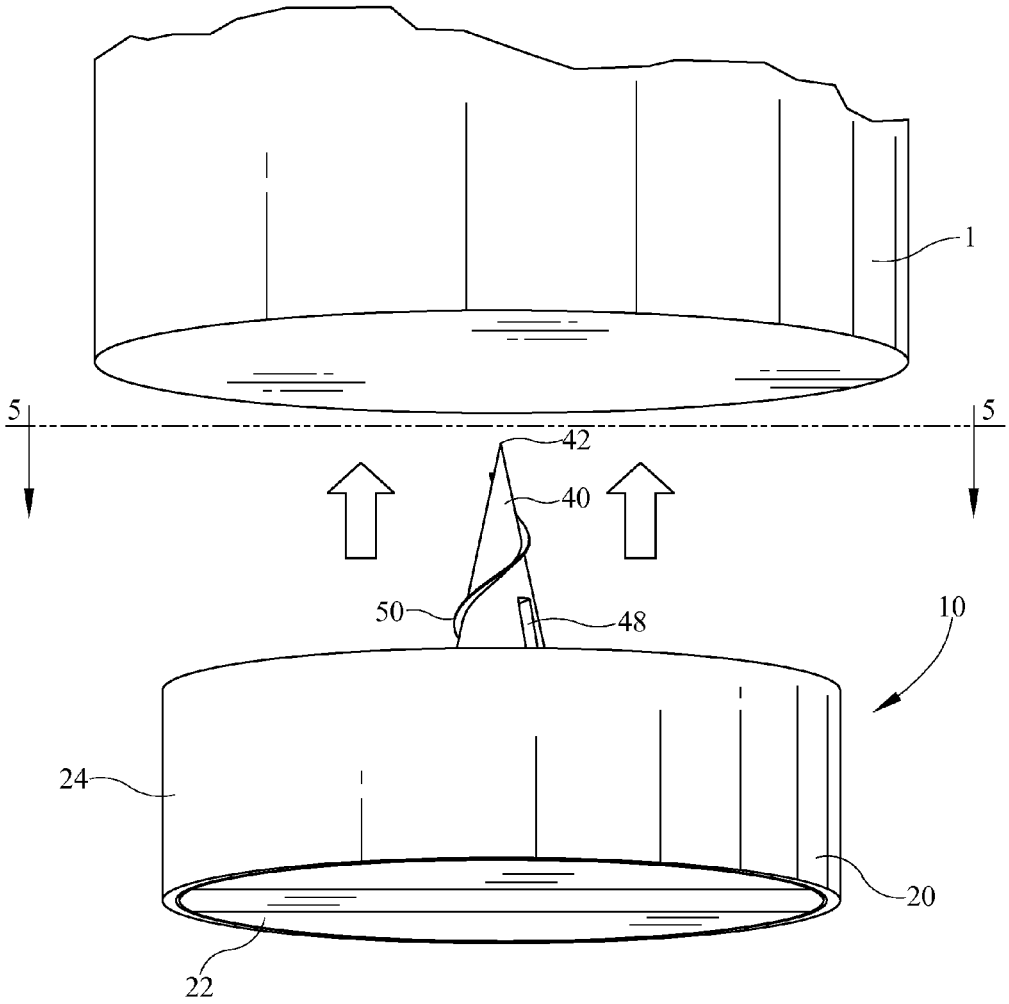
FIG. 1 is an isometric view of a fluid dispenser and a container in accordance with one embodiment of the present invention.

Fluid dispenser 10 further includes a fluid outlet 60 that is, in one embodiment of the invention, recessed in base 20 bottom 22. As shown in FIGS. 1-4, outlet 60 may comprise a flap 62 that is secured to a pivot 64, which is in turn secured to base 20. Flap 62 engages an opening 65 in bottom 20 such that when flap 62 is in a closed position as seen in FIGS. 1 and 2, opening 65 is sealed, thereby containing fluid 2. As seen in FIGS. 3 and 4, when flap 62 is in an open position, fluid 2 is free to flow out from chamber 28.

Figure 6:
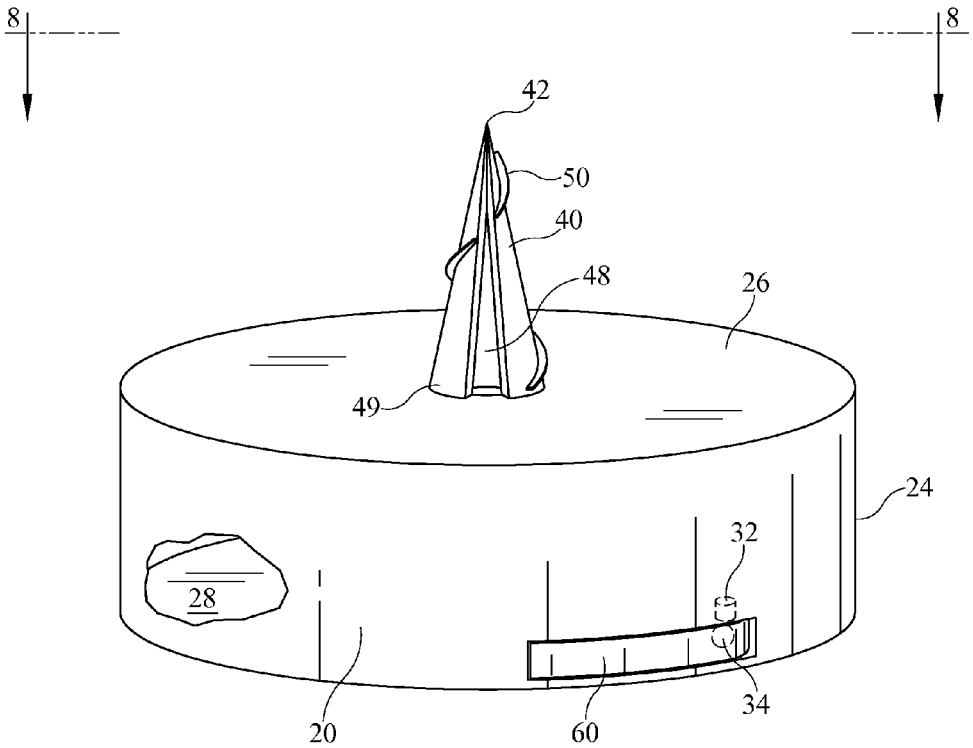
FIG. 6 is an isometric view of a fluid dispenser in accordance with one embodiment of the present invention.
Figure 7:
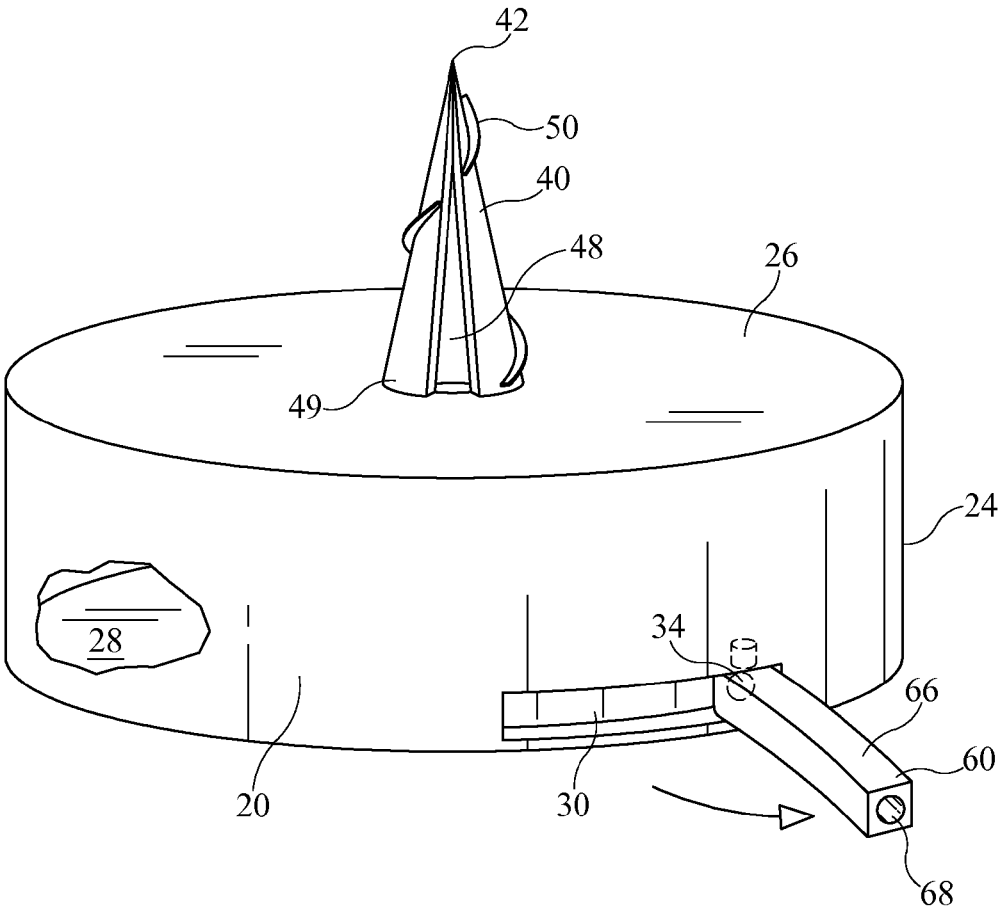
FIG. 7 is an isometric view of a fluid dispenser in accordance with one embodiment of the present invention.

In an alternative embodiment of the present invention as seen in FIGS. 6 and 7, fluid outlet 60 may comprise a hinged member 66 having an aperture or channel 68 that extends completely through hinged member 66. In this embodiment of the invention, base 20 wall 24 may include a recess 30 into which hinged member 66 fits when in a closed position, shown in FIG. 6. Hinged member 66 is rotatable about a hinge 32 disposed in recess 30. When opened, hinged member 66 rotates outwardly, until channel 68 communicates with a corresponding aperture 34 located in recess 30 of wall 24, thereby permitting fluid 2 to flow through aperture 68.

Figure 8:
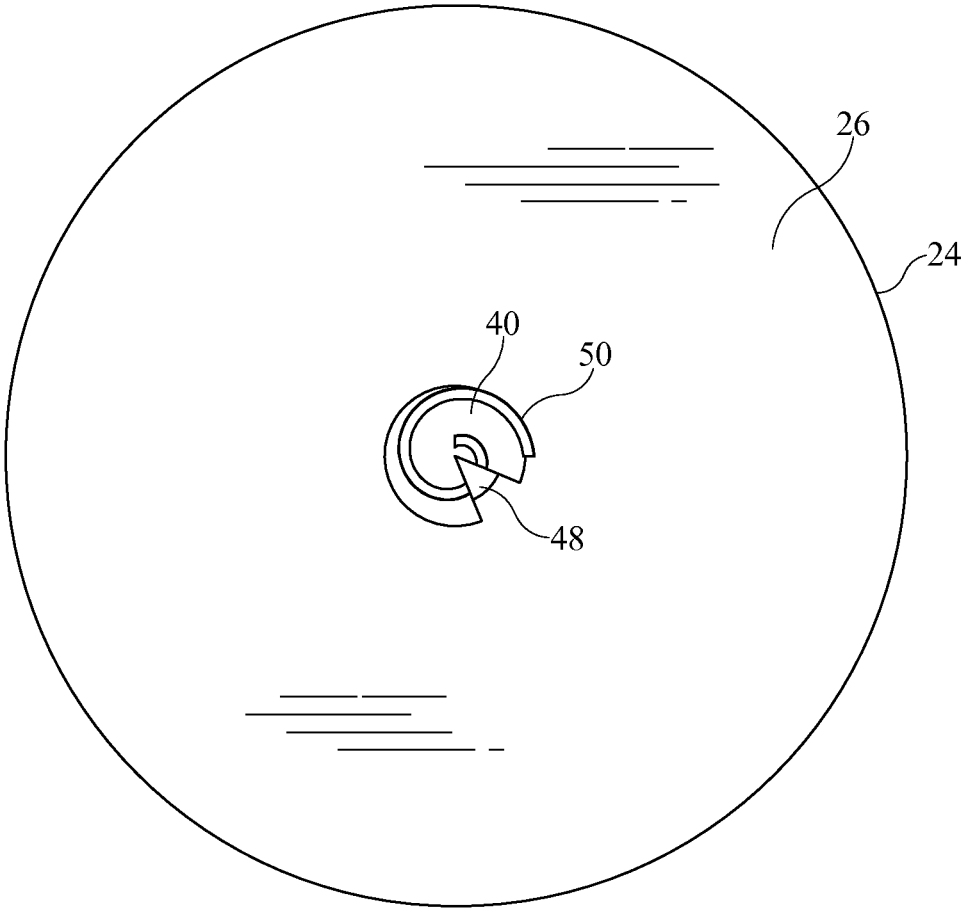
FIG. 8 is a top view of a fluid dispenser taken along the line 8-8 of FIG. 6 in accordance with one embodiment of the present invention.

In a further embodiment of the invention as shown in FIGS. 6-8, piercing member 40 may include an aperture 28 that is shaped as a partial section of generally conical piercing member 40. This embodiment of the invention provides for enhanced fluid 2 flow through aperture 28 into base 20 chamber 28.

In operation, and as best seen in FIGS. 1-4, fluid dispenser 10 is secured to container 1 by simply piercing container 1 with piercing member 40 by forcing base 20 in the direction of the arrows shown in FIGS. 1 and 2. In the embodiment of the invention where piercing member 40 includes helical threads 50 base 20 may be rotated to permit helical threads 50 to engage container 1 as piercing member 40 is advanced into container 1. Once base 20 top 26 is proximate or in contact with container 1, dispenser 10 is fully engaged with container 1. Fluid 2 will flow through aperture 48 into base 20, and a user may simply open fluid outlet 60 to dispense the fluid.

In a yet further embodiment of the invention all components of fluid dispenser 10 are made from a dishwasher safe plastic, for example polypropylene or an equivalent material.

This enables dispenser 10 to be removed from a completely drained container 1 and simply placed in a dishwasher to be cleaned. Furthermore, in this embodiment of the invention, the entire fluid dispenser 10 may be manufactured as an integrated unit, for example through an injection molding process. However, a wide variety of plastics, metals and other materials may be employed in the manufacture and construction of fluid dispenser 10 without departing from the scope of the present invention.

While the present invention has been shown and described herein in what are considered to be the preferred embodiments thereof, illustrating the results and advantages over the prior art obtained through the present invention, the invention is not limited to those specific embodiments. Thus, the forms of the invention shown and described herein are to be taken as illustrative only and other embodiments may be selected without departing from the scope of the present invention, as set forth in the claims appended hereto.

I claim:

1. A dispenser for accessing and removing residual fluid from a container comprising:

a base portion having a chamber therein for containing said fluid and having a side wall with a recess therein, said recess having a fluid outlet aperture in fluid communication with said chamber;

a hinged member capable of rotation around an axis within said recess, said hinged member having a channel therein that is in fluid communication with said fluid outlet aperture when said hinged member is rotated to a predetermined position; and a piercing member extending from said base portion for piercing said container, said piercing member having an aperture therein proximate said base portion whereby said fluid flows through said aperture into said base portion chamber.

2. A dispenser as claimed in claim 1 wherein said fluid outlet is disposed in a bottom portion of said base.

3. A dispenser as claimed in claim 1 wherein said piercing member comprises a helical thread.

4. A dispenser as claimed in claim 1 wherein said piercing member has a terminal portion secured to said base and a distal portion for piercing said container, wherein said terminal portion is substantially wider than said distal portion.

5. A dispenser as claimed in claim 1 wherein said piercing member is generally conical in shape.

6. A dispenser as claimed in claim 5 wherein said piercing member has a terminal portion secured to said base, and wherein said aperture is disposed proximate said terminal portion.

7. A dispenser as claimed in claim 1 comprising:

the base portion having a top portion, a bottom, and a side wall therebetween, said top portion, bottom, and side wall defining said chamber; and wherein said piercing member is secured to said top portion.

* * * * *